US006112782A

United States Patent [19]

Farthing

[11] Patent Number: 6,112,782

[45] Date of Patent: Sep. 5, 2000

[54] COLLAR FOR A FUEL DELIVERY DEVICE

[75] Inventor: Howard J. Farthing, Enfield, United Kingdom

[73] Assignee: Nozzad (UK) Limited, London, United Kingdom

[21] Appl. No.: 09/077,222

[22] PCT Filed: Nov. 21, 1996

[86] PCT No.: PCT/GB96/02868

§ 371 Date: May 20, 1998

§ 102(e) Date: May 20, 1998

[87] PCT Pub. No.: WO97/19015

PCT Pub. Date: May 29, 1997

[30] Foreign Application Priority Data

Nov. 21, 1995 [GB] United Kingdom ..... 9523793

[51] Int. Cl.[7] ..... B65B 1/04

[52] U.S. Cl. ..... 141/392; 141/98

[58] Field of Search ..... 141/392, 98; 40/299, 40/661, 609, 611, 5; 222/23

[56] References Cited

U.S. PATENT DOCUMENTS

| | | | |
|---|---|---|---|
| 3,739,988 | 6/1973 | Kisor et al. | 141/392 |
| 5,058,637 | 10/1991 | Fell | 141/392 |
| 5,184,655 | 2/1993 | Fell | 141/392 |
| 5,273,087 | 12/1993 | Koch et al. | 141/392 |

FOREIGN PATENT DOCUMENTS 2611688 2/1987 France .

*Primary Examiner*—Steven O. Douglas
*Attorney, Agent, or Firm*—Price, Heneveld, Cooper, DeWitt & Litton

[57] ABSTRACT

A collar for fitting over at least a portion of the housing of a fuel delivery nozzle. The collar comprises a main body, an arrangement for securing the main body to the housing, and a collar portion shaped to mateably engage around a portion of the housing and arranged to engage the main body.

33 Claims, 12 Drawing Sheets

COLLAR FOR A FUEL DELIVERY DEVICE

This application is the National Stage of International Application No. PCT/GB96/02868, filed Nov. 21, 1996, which claims the benefit of British Application No. 9523793.9, filed Nov. 21, 1995.

The present invention relates to a collar/display device for a fuel delivery device. In particular, the invention relates to a collar that can be fitted over at least a portion of a housing of a petrol discharge unit and/or a splashguard for the unit.

Figure 1A:
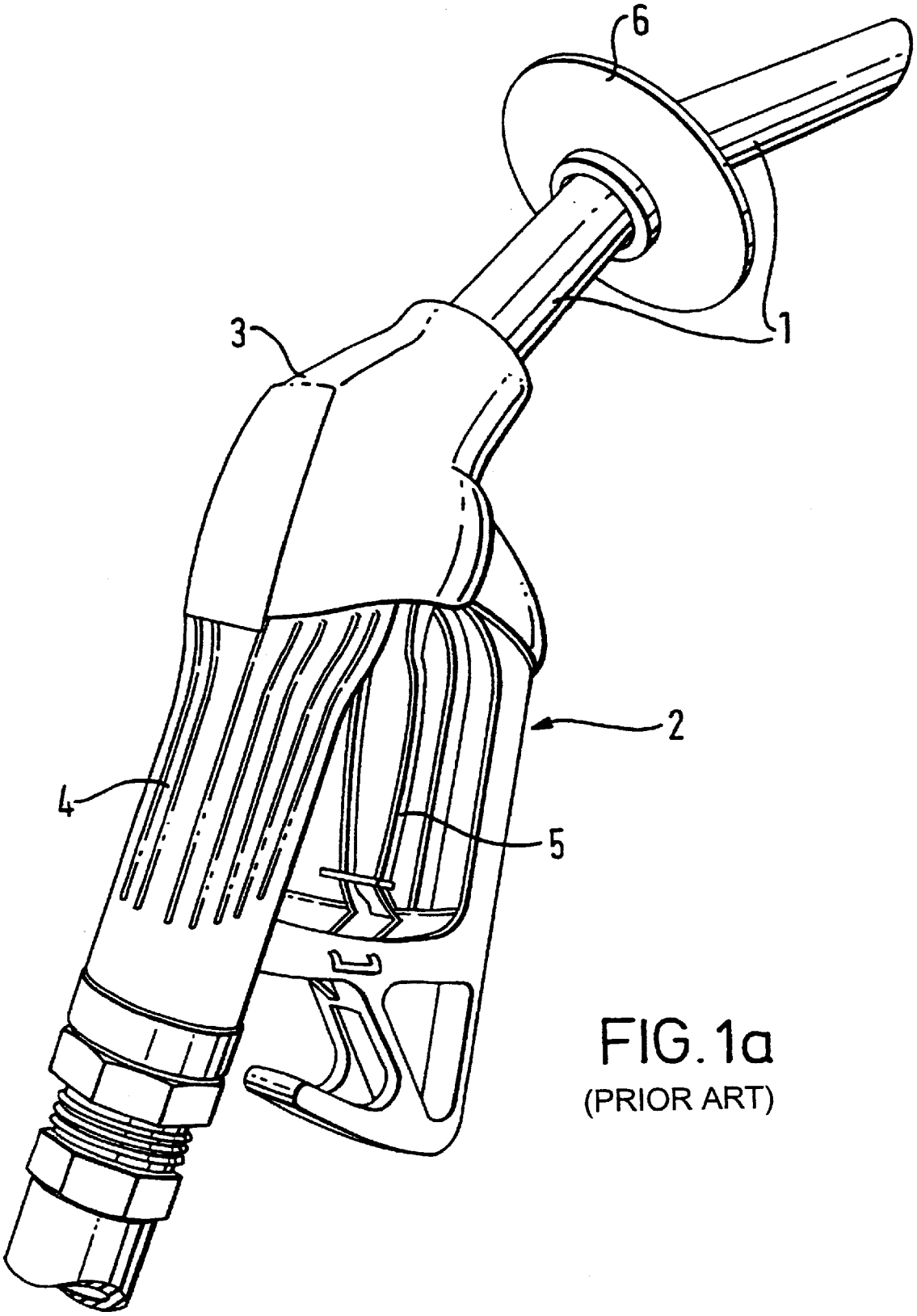
FIG. 1a (PRIOR ART)

Most petrol pumps are provided with a concealed stationary pump for pumping petrol from an underground tank through a fuel pipe to a hand held and manually operable fuel delivery device. A typical fuel delivery device is shown in FIG. 1*a*. Such devices generally comprise the following main parts: a nozzle 1 through which fuel is delivered or discharged; a housing designated generally as 2 which houses a fuel metering valve, the housing having a knuckle portion 3 containing means for adjusting the valve; and a handle 4 which is held by the person dispensing the fuel. The handle usually has a trigger (or lever) 5 for adjusting the rate of fuel discharge and a finger guard. In addition a splashguard 6 may be provided on the nozzle to prevent fuel delivered by the device splashing back from the tank being filled. A commonly used fuel delivery device of the type shown in FIG. 1*a* is the ZVA (a Trade Mark) nozzle available from Elaflex Limited of the United Kingdom. Further well known devices include the OPW (a Trade Mark) nozzle from OPW Fueling Components Europe (BV) of the Netherlands, the Huskey (a Trade mark) nozzle available from Huskey Corporation of Tucson, Ariz., USA and the EMCO Wheaton (a Trade Mark) nozzle available from EW Fuel Management Limited of the United Kingdom.

Although the type of fuel is often displayed on or near the petrol pump itself, with the increasing variety of fuels available for motor vehicles there is a continuing need to ensure that a motorist wishing to refill with fuel does so using the correct type of fuel. Not only is petrol available in various grades such as four-star, but also as unleaded petrol (or lead-free) as well as special unleaded fuel that is intended to give improved performance (sometimes termed super-unleaded).

When one additionally considers diesel, this results in many different types of fuel being commonly available at petrol filling stations. It is imperative that the motorist fills the tank of his motor vehicle with the correct type of fuel (since most engines will only run on one type) and this is all the more reason why the correct fuel type needs to be clearly indicated.

In order to ensure that the correct type of fuel is chosen, the fuel delivery device is often labelled with the type of fuel it delivers in addition to the pump itself. Furthermore, the fuel line may be colour coded (for example, red for leaded petrol, green for unleaded and black for diesel). In addition the housing is usually covered by a flexible rubber shroud or "scuffguard" which usually covers the knuckle portion that contains the valve adjustment means.

The scuffguard is sometimes colour coded depending upon the type of fuel to be dispensed by the device (as described previously).

One known way of providing an additional indication of the type of fuel delivered by the delivery device is to replace the scuffguard altogether with a flexible cover having an internal configuration suitable to fit over the housing. The replacement scuffguard includes a generally planar upper portion onto which information material such as a suitably shaped piece of paper, plastic or cardboard having the information printed thereon is placed and retained by a clear cover having side walls which clip over the planar portion of the replacement sleeve, retaining projections on the side walls mating with corresponding recesses provided on the sleeve. Various problems are associated with the arrangement. In particular it is difficult to remove and replace the original scuffguard and by doing so, manufacturing or source information found on the original scuffguard is lost. In addition the cover can be easily removed and the information material lost either inadvertently or by acts of vandalism.

An improvement to the system comprises a collar which is configured to fit over all or a portion of the scuffguard and be retained in place, for example by a clip or other suitable retaining means. Such an arrangement is more easily removable and interchangeable.

Recently, a new type of fuel delivery device has been introduced including a vapour recovering nozzle. The general structure of the vapour retrieving nozzle device is similar to that of the conventional fuel delivery device shown in FIG. 1*a*. In addition, however, in one variant the nozzle 1 is surrounded at its end nearest the housing 2 by a coaxial cylindrical sleeve projecting from the housing 2. The precise manner of operation of the vapour retrieval device is well known and is not of immediate relevance to the present invention. However, in summary, as fuel is delivered by the device into the petrol tank of a vehicle, fuel vapour already in the tank of the vehicle is displaced out of the tank and is channelled through the passage between the nozzle and the surrounding cylindrical sleeve and stored in an appropriate tank provided at the fuel station. Alternatively the nozzle can include perforations along its length for retrieving vapour.

Figure 1B:
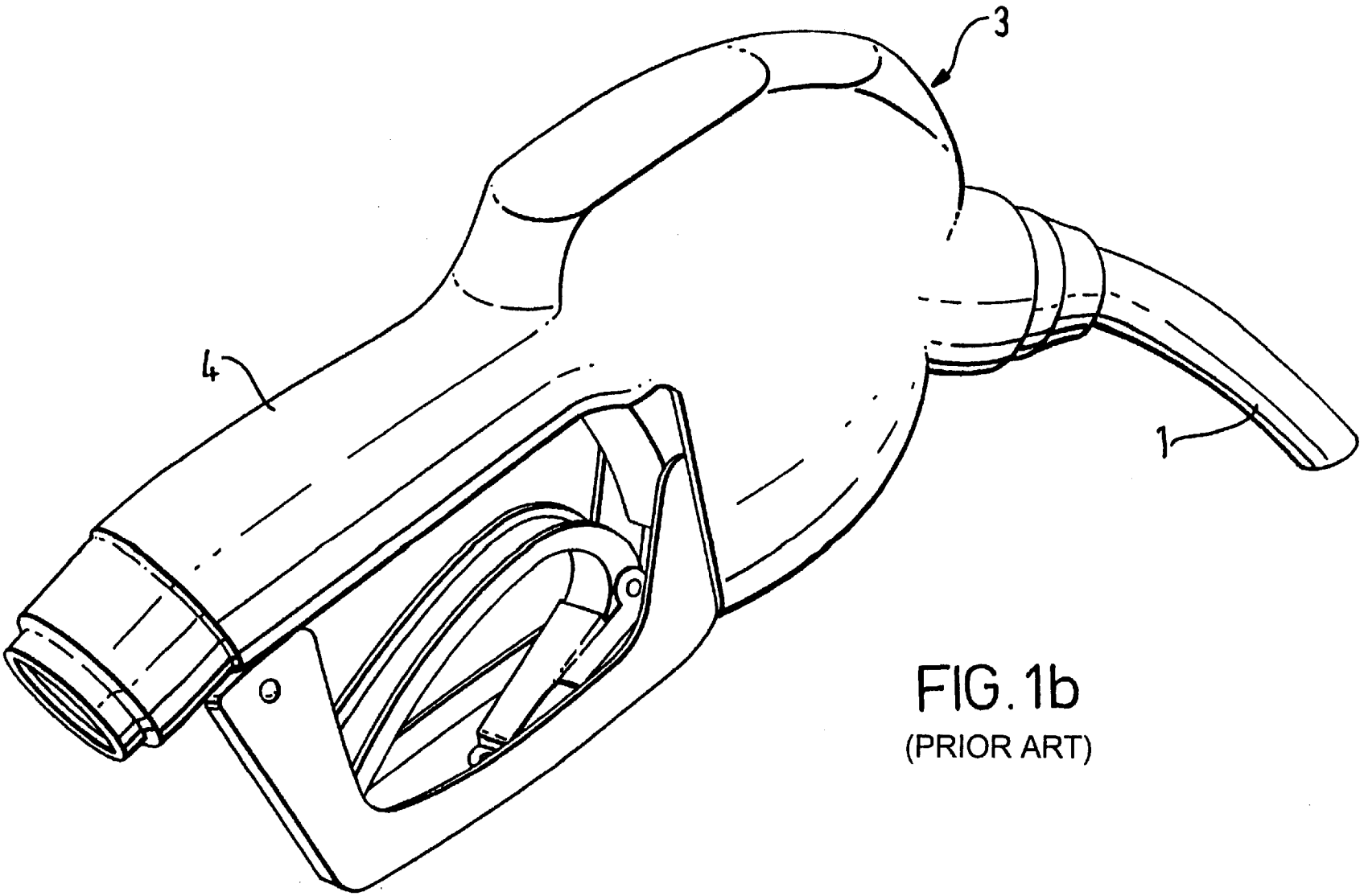
FIG. 1b (PRIOR ART)
Figure 1C:
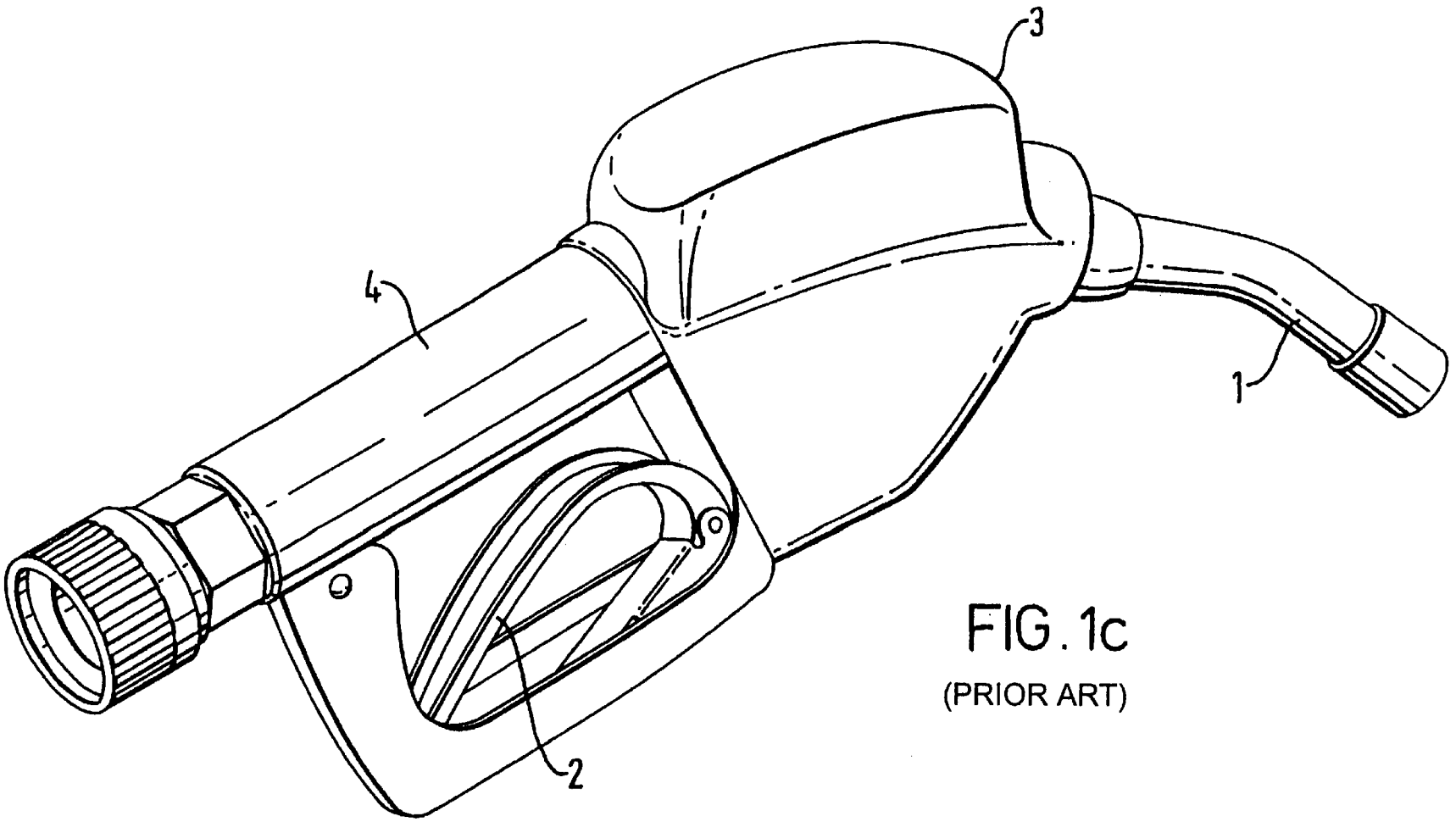
FIG. 1c (PRIOR ART)

An OPW nozzle of the vapour recovery type is shown in FIG. 1*b*. As will be seen it includes an exaggerated knuckle portion 3 extending substantially above the handle 4, to house the vapour recovery mechanism. The knuckle portion 3 is also of greater length than in FIG. 1*a*, and extends below the device, filling in the space between the front end of the finger guard and the nozzle 1. FIG. 1*c* shows the OPW standard nozzle in which, it will be seen, the knuckle portion 3 is slightly less exaggerated.

The vapour recovery fuel delivery devices, like the conventional fuel delivery devices, are provided with a scuffguard. However the profile of the scuffguard differs between the devices, principally because of the differing pumping and dispensing mechanisms found in the housing in each case. In particular, the profile of the scuffguard on the vapour retrieval device is rather fuller as the vapour recovery mechanism is provided at least partially in the housing. In the commonly used ZVA vapour recovery-type device the housing, when viewed from the side is more convex or bulbous in the upper front region than the standard ZVA device.

Accordingly a problem arises with the known devices as existing arrangements are not suitable for use with both types of device. The scuffguard replacement cover for example must be remoulded to fit the vapour recoverytype delivery device, as must the improved collar arranged to fit over the scuffguard.

In addition, because of the provision of the vapour recovery sleeve surrounding the nozzle on the vapour retrieval device, or the alternative configurations, the existing scuffguard replacement arrangements may not even fit onto the vapour retrieval device as they are obstructed by the vapour retrieval sleeve.

According to the invention there is provided a collar for fitting over at least a portion of the housing of a fuel delivery device wherein the collar comprises a main body, means for securing the main body to the housing and a collar portion shaped to mateably engage around a portion of the housing and arranged to engage the main body. As a result the collar can be fitted firmly and securely to the housing. The collar portion preferably comprises a splashguard, allowing an advantageous duplication of function.

The collar portion may be arranged to mateably engage around the housing of a conventional fuel delivery device or around the housing of a vapour recovery fuel delivery device. Thus, only the collar portion needs to be changed dependent on the type of delivery device, the other components being commonly usable.

The collar portion may be shaped to mateably engage around the housing of a fuel dispensing device, the housing including a scuffguard. The collar can thus be placed over the delivery device without the need to remove the scuffguard.

The main body may include a portion for displaying information, and a protective cover may be provided for the information display, and wherein the protective cover is configured to be retained within a surrounding wall of the main body. The cover is thus substantially tamper-proof. The protective cover may be retained in the main body by detent means, the information display obscuring the detent means to further discourage tampering. The main body may include channels through which the protective cover may be pushed from the underside of the main body to detach the protective cover from the main body. Thus the information display may be simply changed by authorised personnel.

The main body may be secured against the housing by a tie encircling the housing.

According to the invention there is further provided a kit for a collar for fitting over the housing of a fuel dispensing device, the kit comprising a main body, means for securing the main body to the housing and either of a first or a second collar portions arranged to mateably engage around the housing of a respective first or second type of fuel delivering device. The first collar portion may be shaped to mateably engage around the housing of a conventional fuel delivery device and the second collar portion may be shaped to mateably engage around the housing of a vapour recovery fuel delivery device.

According to the invention there is further provided a display device for a fuel delivery device, the display device including a main body securable to the fuel delivery. device for displaying information and a protective cover releasably attachable to the main body for covering the information display wherein the protective window is received within the main body.

According to the invention there is further provided a method of attaching a collar to the housing of a fuel delivery device, the collar including a main body, securing means and a collar portion, in which the main body is secured to the housing by the securing means, the collar portion is placed around the nozzle of the fuel delivery device and brought into mateable engagement around a portion of the housing and into engagement with the main body.

According to the invention there is further provided a method of changing the information display on a collar for a fuel delivery device wherein the collar comprises a main body, an information display and a protective cover for the information display surface detachably fastened to and received within the main body, comprising the steps of pushing the protective cover out of engagement with the main body through a channel from the underside of the main body.

According to the invention there is further provided a splashguard for a fuel delivery device having a delivery nozzle, the splashguard including a nozzle receiving aperture situated eccentrically substantially adjacent an edge of the splashguard.

Figure 2:
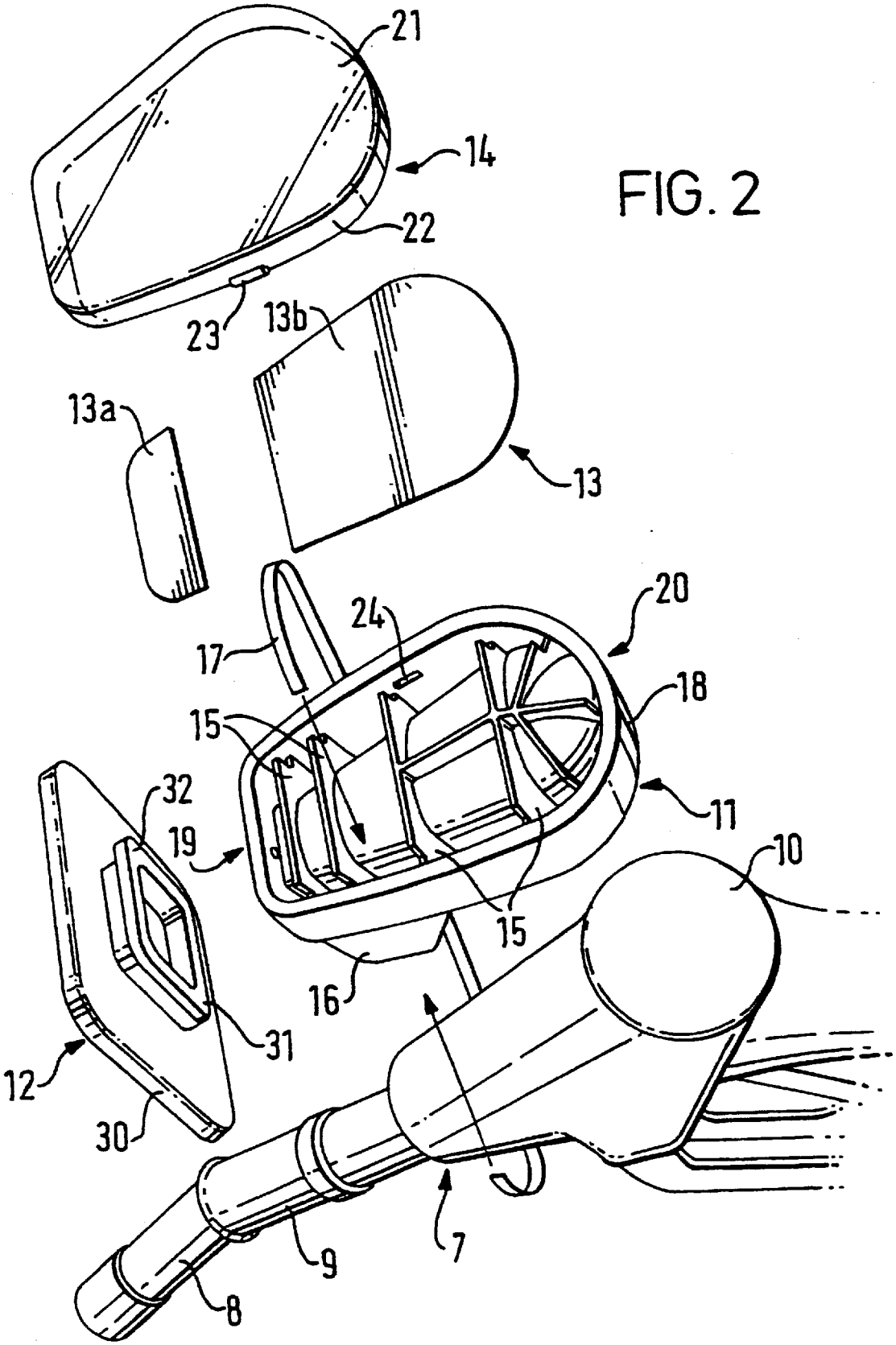
Figure 3A:
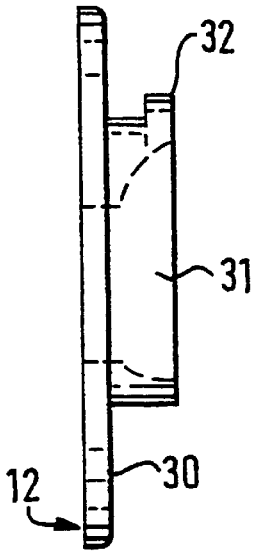
Figure 3B:
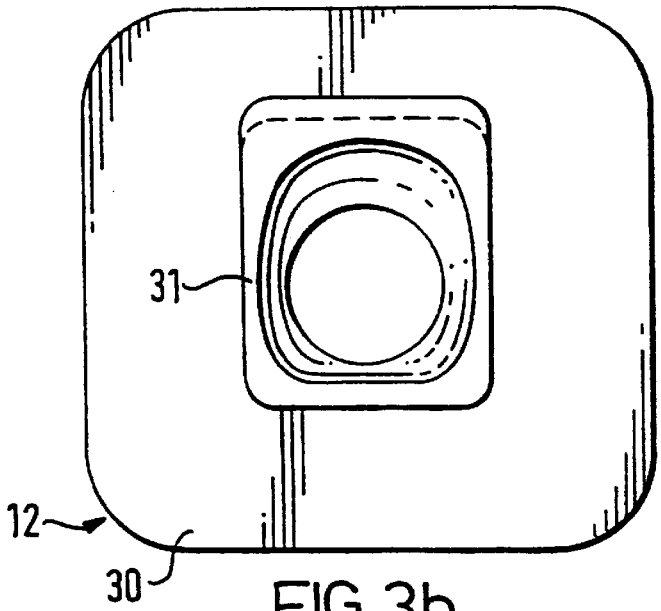
Figure 4A:
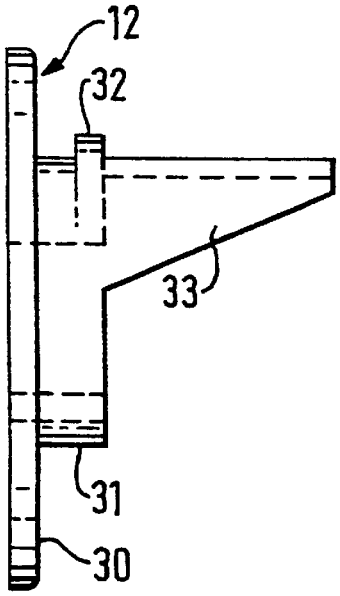
Figure 4B:
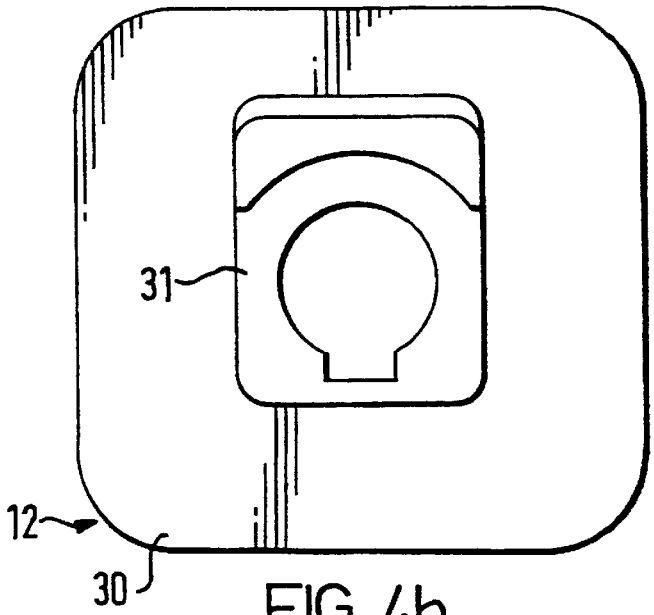
Figure 5A:
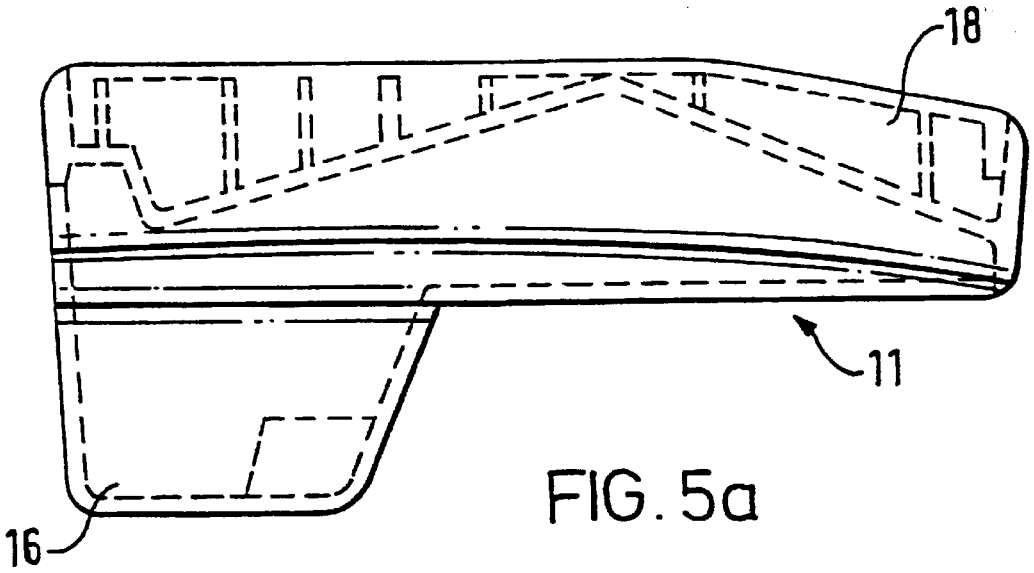
Figure 5B:
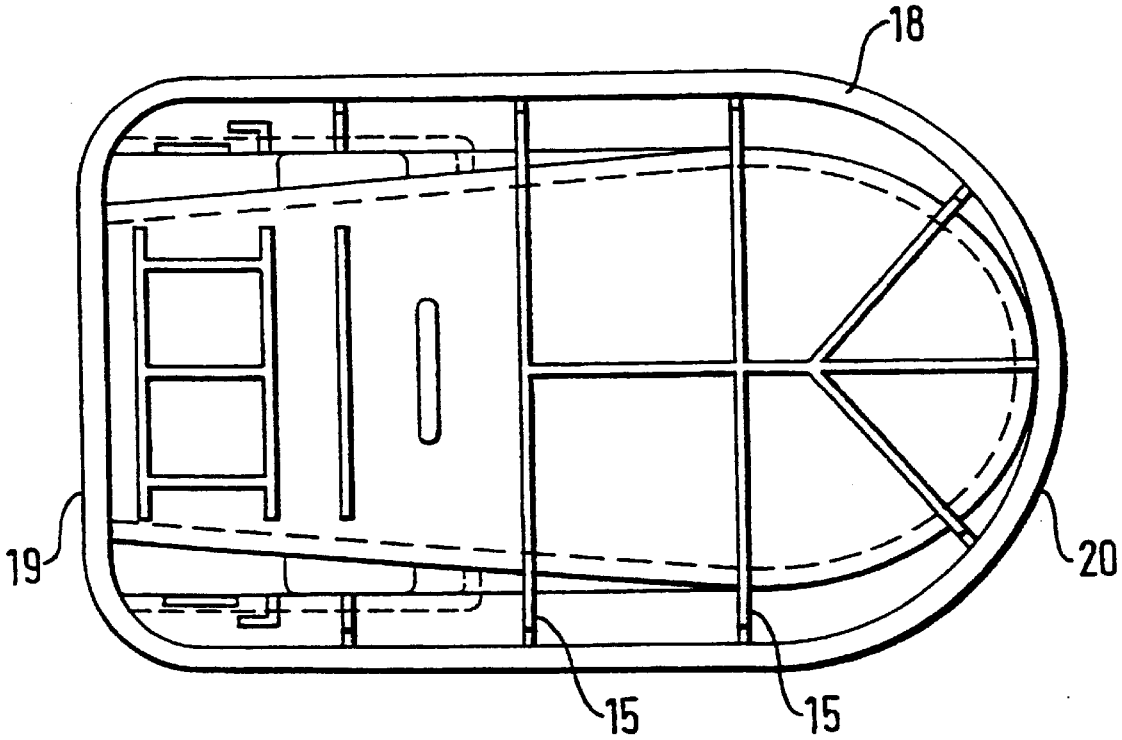
Figure 5C:
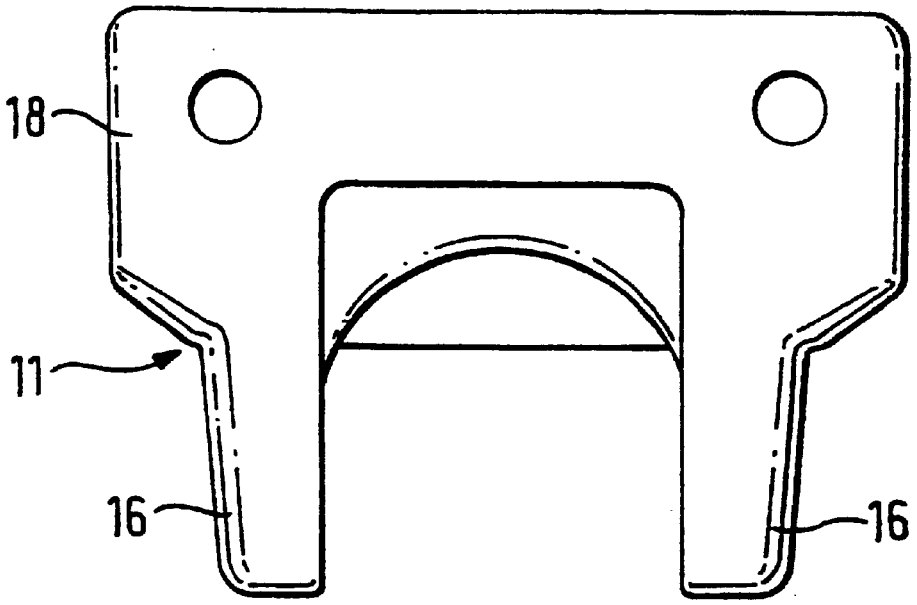
Figure 5D:
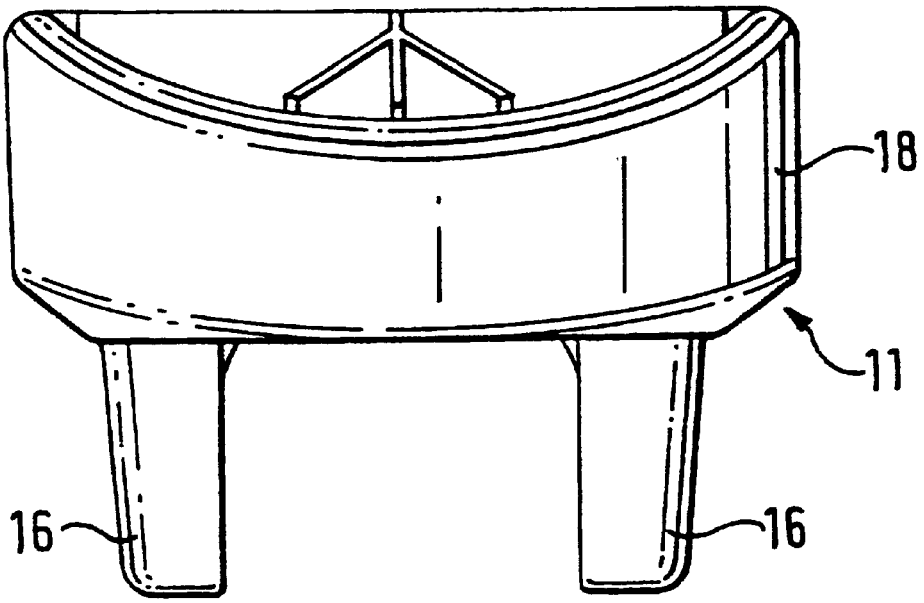
Figure 5E:
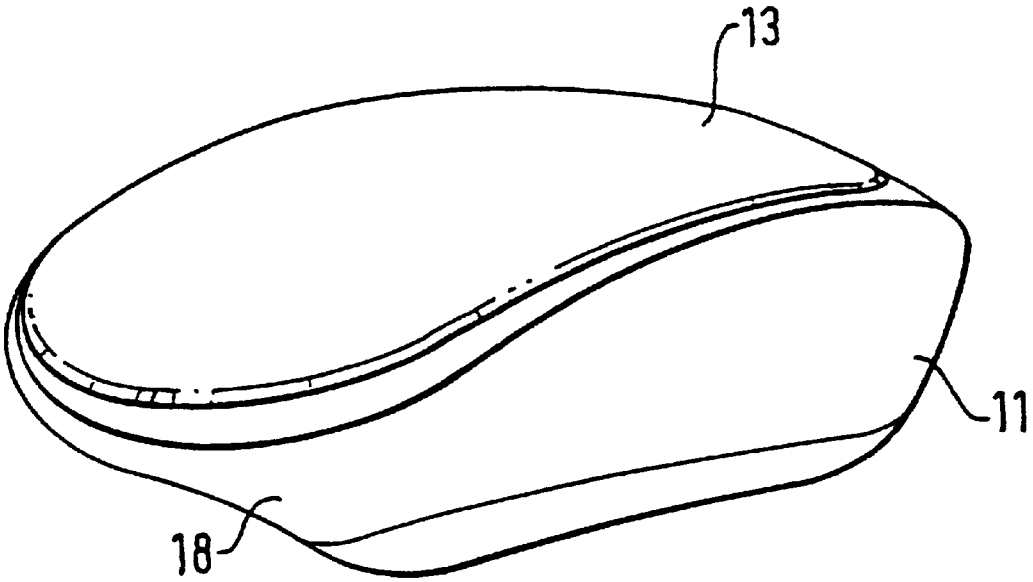
Figure 5F:
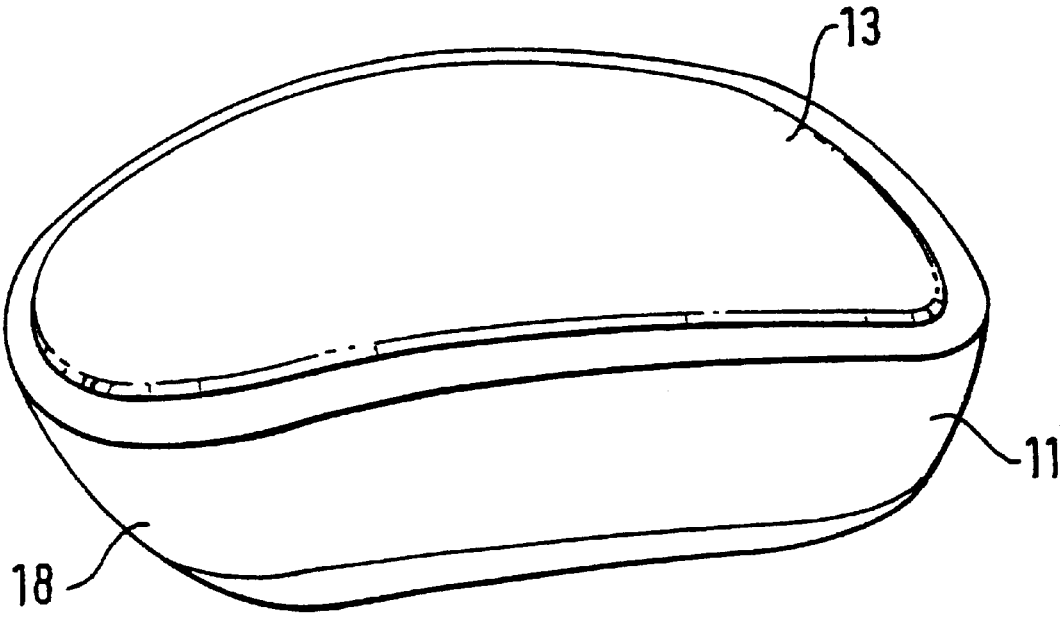
Figure 6A:
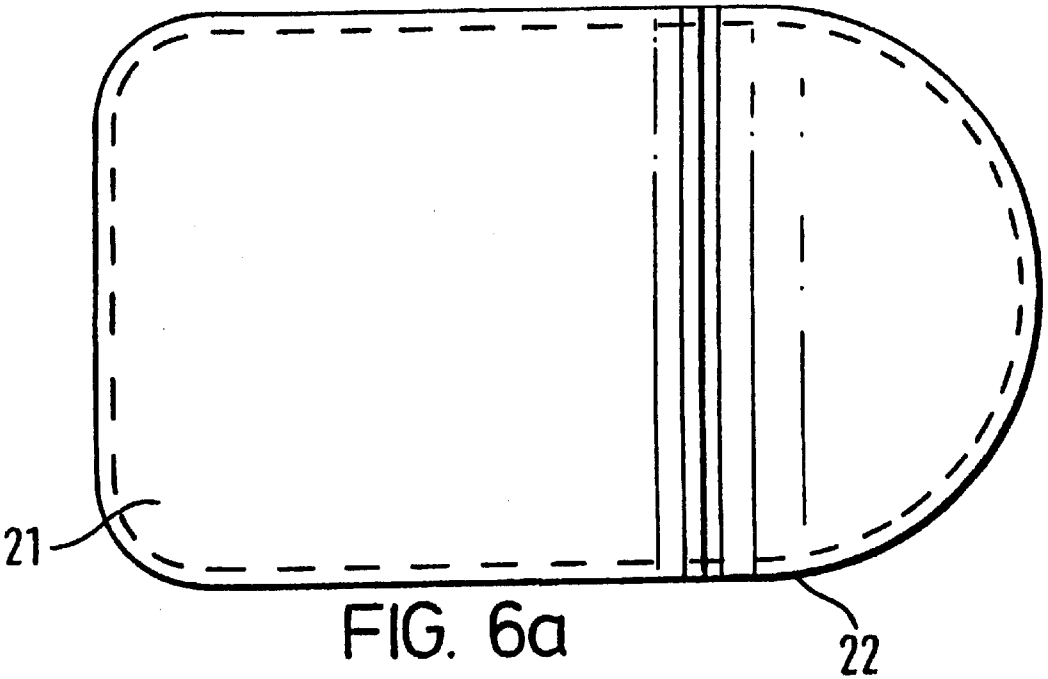
Figure 6B:
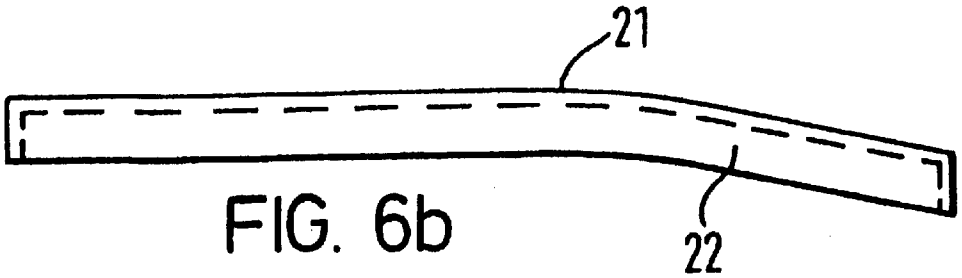
Figure 7C:
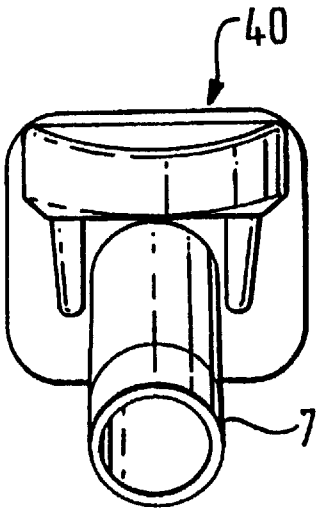
Figure 7B:
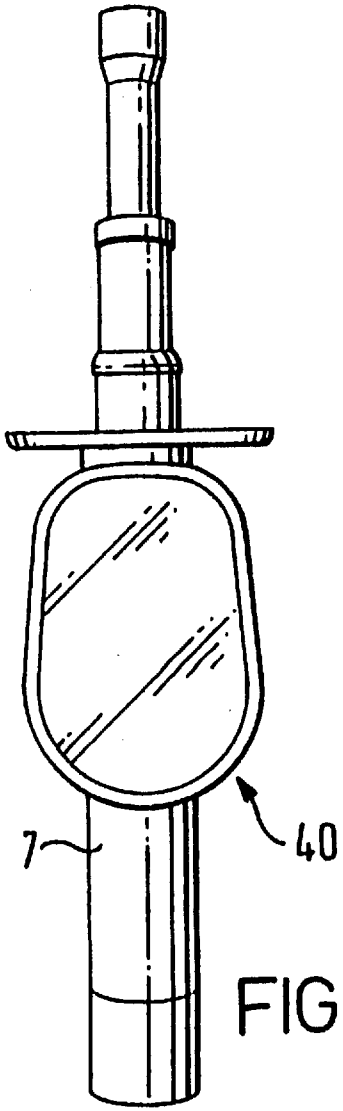
Figure 7A:
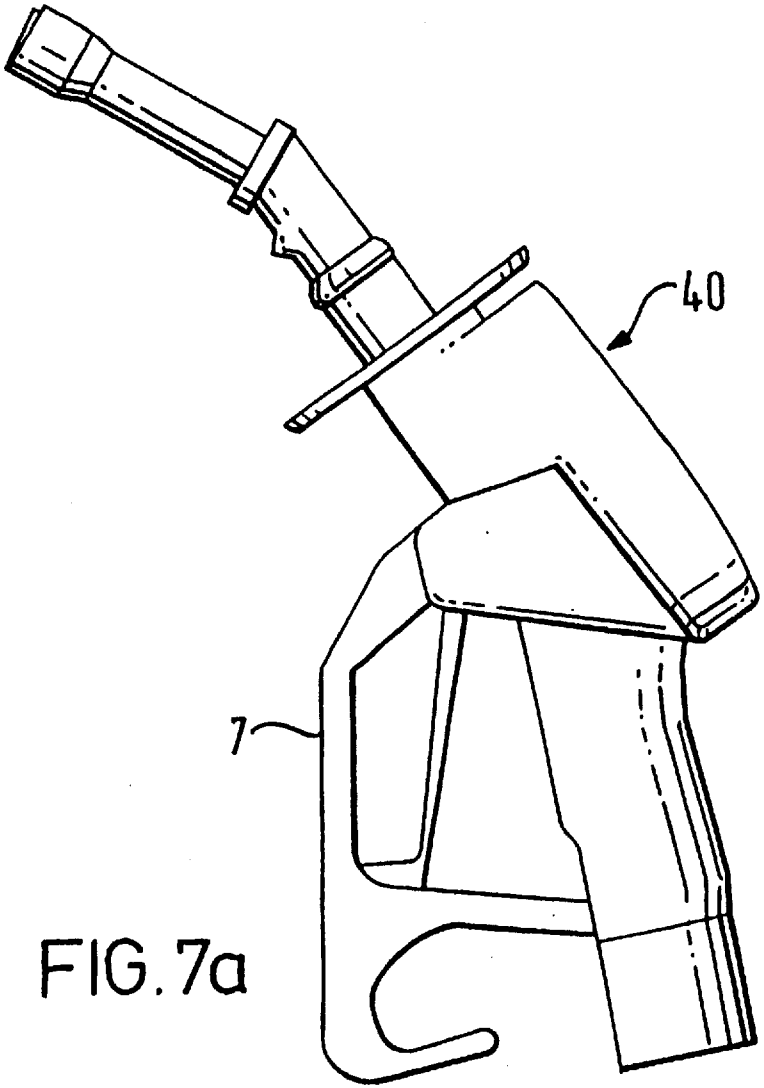

Embodiments of the invention will now be described by way of example with reference to the drawings of which:

FIG. 1*a* is a perspective view of a conventional fuel delivery device;

FIG. 1*b* is a perspective view of a conventional vapour recovery fuel delivery device;

FIG. 1*c* is a perspective view of an alternative conventional fuel delivery device;

FIG. 2 is an exploded view showing the parts of a collar according to one form of the present invention;

FIG. 3*a* is a side view of a first type of splashguard according to the present invention;

FIG. 3*b* is a view of the splashguard of FIG. 3*a* from the rear;

FIG. 4*a* is a side view of a second type of splashguard according to the present invention;

FIG. 4*b* is a view of the splashguard of FIG. 4*a* from the rear;

FIG. 5*a* is a view of the main body of the collar of the present invention from the side;

FIG. 5*b* is a view of the main body from above;

FIG. 5*c* is a view of the main body from the front;

FIG. 5*d* is a view of the main body from the rear;

FIG. 5*e* is a perspective view of an alternative main body;

FIG. 5*f* is a further perspective view of the alternative main body;

FIG. 6*a* is a view of a protective cover according to the present invention from above;

FIG. 6*b* is a view of a protective cover from the side;

FIG. 7*a* is a side view showing a vapour retrieval device with the collar in position;

FIG. 7*b* is a view from above corresponding to FIG. 7*a*; and

FIG. 7*c* is a front view corresponding to FIG. 7*a;*

Figure 8C:
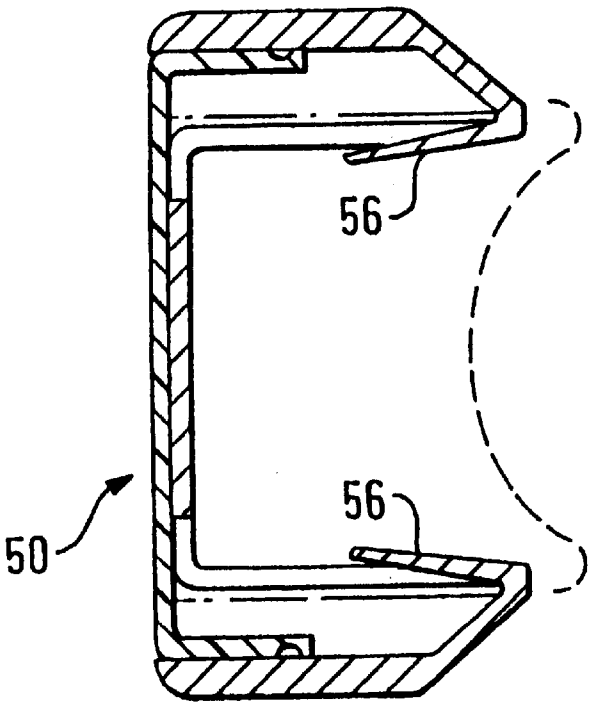
Figure 8A:
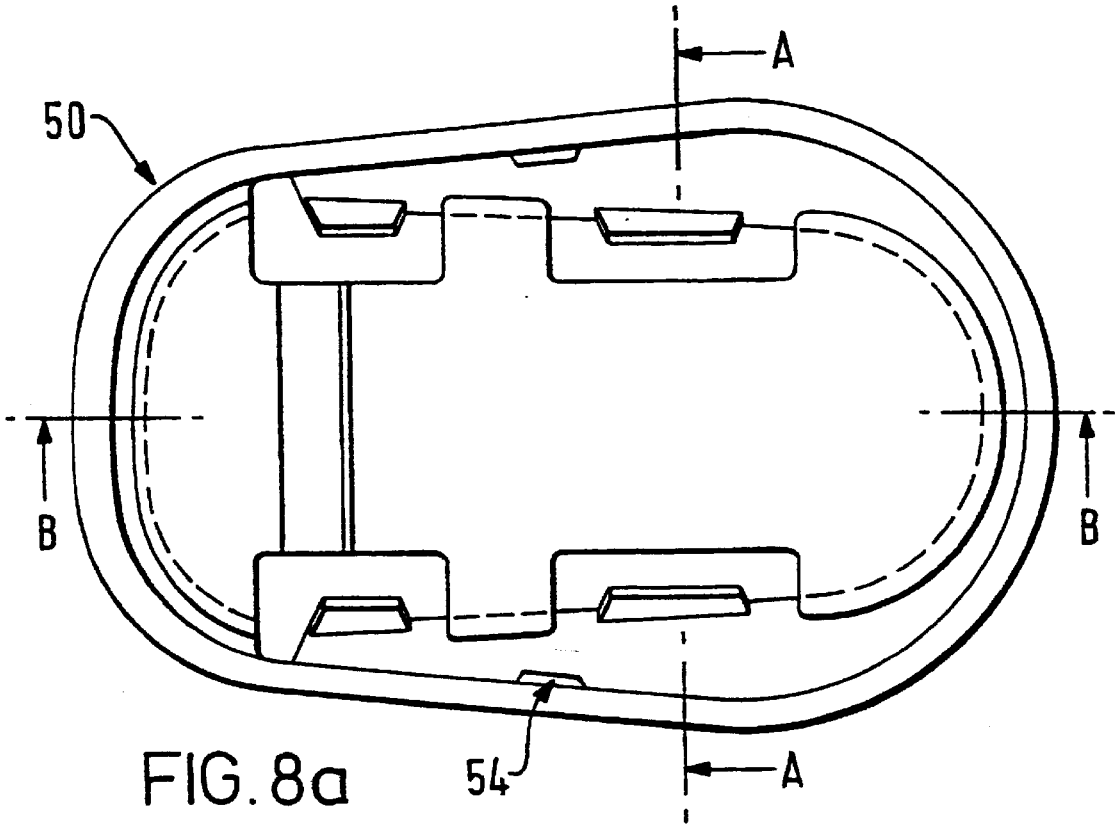
Figure 8B:
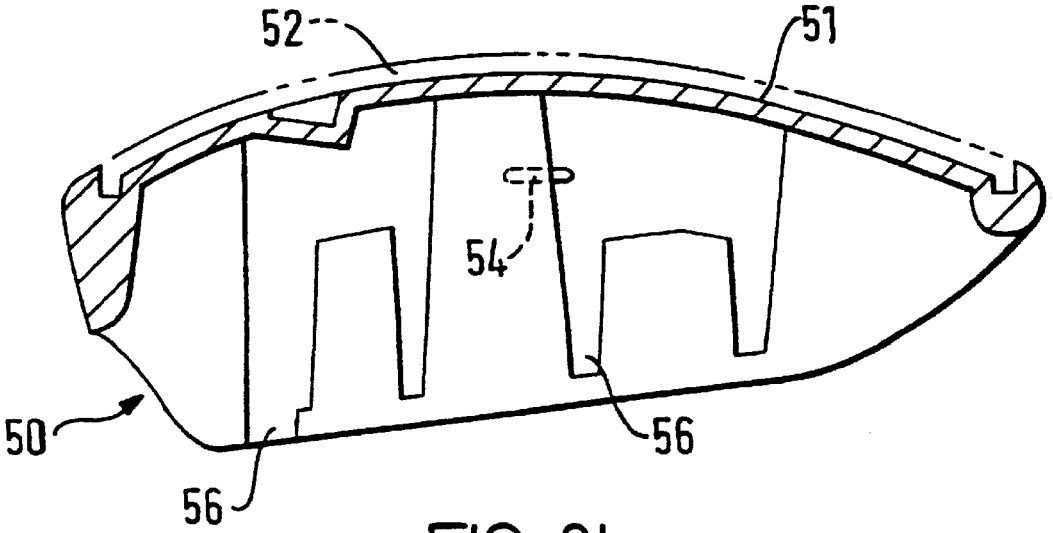
Figure 9A:
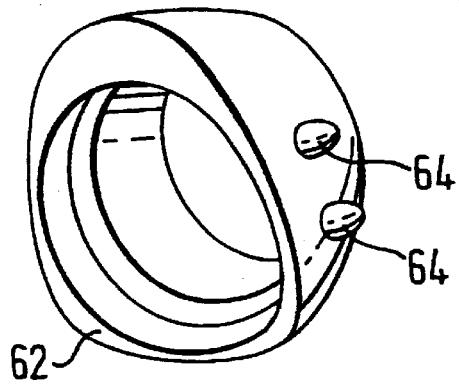
Figure 9B:
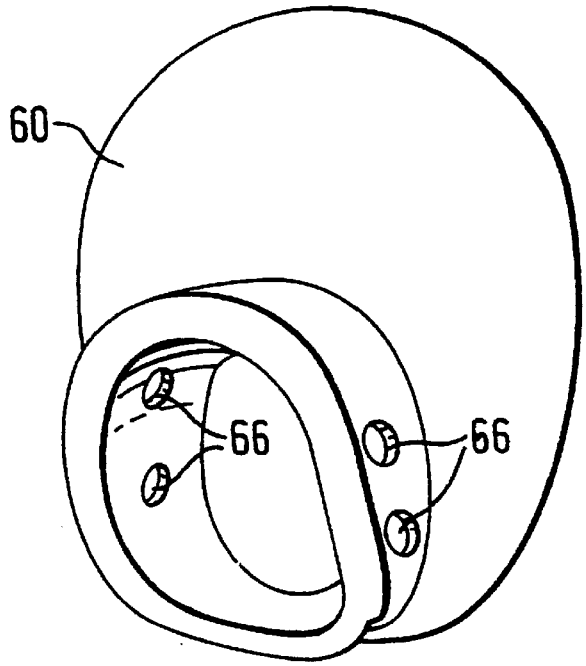
Figure 10:
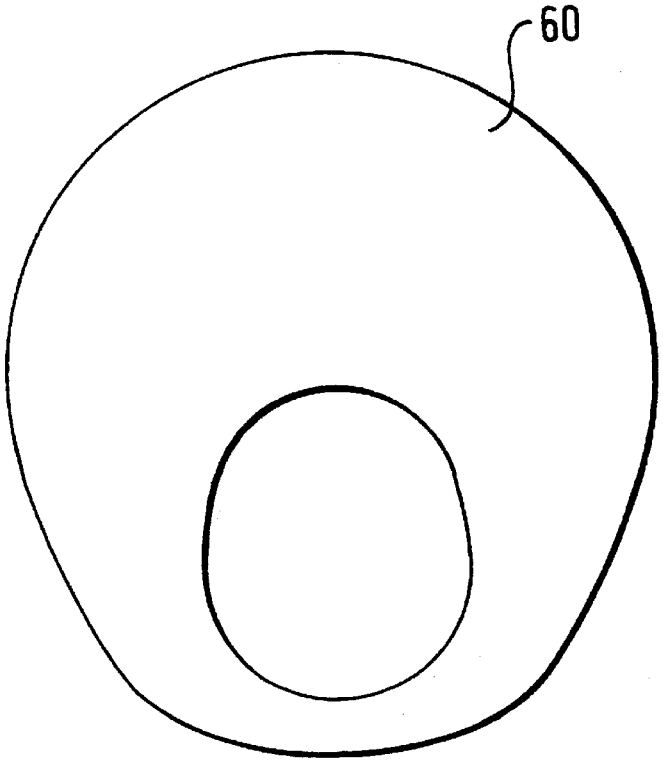

FIG. 8*a* is a plan view of an alternative configuration of the main body;

FIG. 8*b* is a sectional view of the main body shown in FIG. 8*a* along line BB;

FIG. 8*c* is a sectional view of the main body shown in FIG. 8*a* along line AA;

FIG. 9*a* is a perspective view of an adapter for a collar portion according to the present invention;

FIG. 9*b* is a perspective view of a collar portion for incorporation with the adapter of FIG. 9*a*; and FIG. 10 shows an alternative splashguard shape according to the present invention.

Throughout the specification the terms "front" and "forward" relates to the fuel delivery nozzle end of the arrangement and other terms are to be construed accordingly. Reference numerals, where appropriate, relate to the same features throughout the specification.

The various parts of the collar according to the present invention are shown in FIG. 2 in relation to a vapour recovery-type fuel delivery device 7 including a nozzle 8, a vapour retrieval sleeve 9 and a scuffguard 10.

The collar comprises a main body 11, a splashguard 12, an information display sheet 13, a protective cover 14 and a securing means 17.

The main body 11 is moulded from a petrol resistant, inflammable material of any known type and, as shown in FIG. 5, includes a peripheral wall 18 defining a central aperture with internal ribs 15 providing structural support and defining a surface on which the information display surface 13 can rest. Viewed from above, the peripheral wall of the main body 11 comprises two long walls terminating at a squared or rounded (in other embodiments not shown here) end 19 at the front of the main body and a rounded end 20 at the rear of the main body. In the embodiment shown a skirt 16 depends from the peripheral wall 18 as may best be seen in FIG. 5*a* and is configured to enclose a portion of the scuffguard 10. As may be seen in FIG. 5*a* the skirt 16 depends only from the front portion of the main body 11 in order to clear the portion of the scuffguard 10 covering the trigger guard. Of course, dependent on the type of fuel delivery device the skirt may be omitted, as shown in FIGS. 5*e* and 5*f*. This configuration is suitable, for example, for the nozzle types shown in FIGS. 1*b* and 1*c* having exaggerated knuckle portions 3 extending below the device. The embodiment shown in FIGS. 5*e* and 5*f* includes a continuously, slightly curved display surface 13 as discussed in more detail below.

Referring to FIGS. 5*c* and 5*d* it can be seen that viewed from the front or rear the main body 11 is of generally an inverted U-shape, the optional skirt portion 16 comprising the downward limbs of the U-shape. Accordingly the main body may be simply placed over the scuffguard 10. The main body 11 is secured to the fuel delivery device 7 by any suitable securing means shown generally as 17 in FIG. 2, for example a hose clip, a reusable cable tie. The securing means 17 are preferably releasably fastenable in order to facilitate replacement of the arrangement as a whole. The securing means 17 pass around a formation contained within the peripheral wall 18 of the main body 11 and around the scuffguard 10 and, in use is hidden by the information display sheet 13. An alternative securing means as discussed in more detail below comprises hook-type projections arranged to engage between for example the scuffguard and the fuel delivery device, where appropriate.

The main body 11 has a downwardly curving rear portion when viewed from the side and may also be configured to define two information display sheet supporting surfaces to support a two-part information display sheet 13 comprising parts 13*a* and 13*b*. The information display sheet 13 may, in addition to or alternatively to displaying information concerning the fuel dispensed by the fuel dispensing device also display advertising material or other informational material. For example a smaller information display sheet 13*a* could display information relating to the fuel dispensed by the device and could be permanently fixed in the main body 11 whilst larger information display sheet 13*b* could be removable and display advertising material.

The information display sheet 13 is retained in the main body 11 by means of a protective cover or window 14. The protective cover 14 serves not only to protect the information display sheet 13 from damage by the elements and petrol splashes but also prevents the information display sheet 13 from being removed from the main body 11 either inadvertently or by vandals. It is manufactured in a transparent petrol resistant material of a known type and may be, for example, of 2 mm wall thickness. The cover 14 includes a cover surface 21 through which the information material may be viewed and shaped to match the profile of the main body, including as shown in FIG. 6*b* a downwardly curving rear portion which is generally shaped to fit snugly within an upper recess of the main body 11 bounded by the peripheral wall 18 of the main body 11. The protective cover 14 further includes a depending wall 22 running around its periphery and provided with projections arranged to mate with corresponding recesses 24 in the peripheral wall 18 of the main body 11. Alternatively, as discussed in more detail elsewhere in the specification, the recesses may be formed on the cover wall 22 and the projection on the body wall 18. In either case a clip-in locking mechanism is provided. Because the protective cover 14 fits within the peripheral wall of the main body it presents an obstacle to vandals attempting to remove the cover 14, in particular because when the cover 14 and information display sheet 13 are in place the means by which the cover 14 is retained in the main body 11 cannot be seen. When, however, it is desired to replace the information or advertising material contained on the information display sheet 13 the protective cover 14 may be easily removed from the main body 11 by pushing up through the underside of the main body 11 using the aperture between the ribs 15. The message sheet 13 can be simply removed in a similar manner.

Referring to FIGS. 3*a*, 3*b*, 4*a* and 4*b*, the splashguard 12 is manufactured from a petrol resistant material of a known type. Generally the material of the splashguard 12 will be more flexible than that of the main body 11 in order to avoid damage being caused to user's vehicles when the splashguard comes into contact with the vehicle body. The splashguard 12 includes a front, generally planar surface 30 of suitable dimensions (e.g. roughly 100 $mm^2$) to catch any splashes coming from the petrol tank being refuelled, and a rear projecting portion or lug 31. An aperture passes through the front 30 and rear 31 portions enabling the splashguard 12 to be placed over the nozzle 8 and vapour retrieval sleeve 9 of the fuel delivery device 7. The splashguard 12 is further internally shaped to cover snugly a front portion of the scuffguard 10, an internal surface of the projection 31 mating with the external surface of the portion of the scuffguard 10. The projecting portion 31 also includes a projecting lip 32 on its rear upper face. When the splashguard is placed over the nozzle 8 and vapour retrieval sleeve 9 of the fuel delivery device 7, and is brought into engagement with the front portion of the scuffguard it also engages with the main body, the rear projecting rib 32 engaging a corresponding recess in the main body portion to retain the parts in position and in engagement. The projection 31 is shaped externally to mate with a portion of the main body 11. As a result, the main body 11 is held securely in place against the scuffguard 10 with little or no play.

Accordingly the splashguard 12, as it is configured to fit snugly over the front portion of the scuff guard retains the arrangement as a whole firmly in place on the scuffguard. As can be seen from FIGS. 4*a* and 4*b*, in one embodiment the configuration of the splashguard 12 is rather different if the arrangement is to be placed on a conventional fuel delivery device. In that case the rear projection 31 includes an upper rear extending snout 33. This additional portion 33 is required to "fill in" the profile of the conventional device scuffguard, which is less bulbous than that of the vapour retrieval-type scuffguard, in order to ensure a secure fit for the information display arrangement as a whole. Accordingly, in order to modify the information display arrangement dependent on which type of fuel delivery device is required, it is only necessary to vary the type of splashguard used. Thus significant remoulding or retooling costs and problems are avoided and it is simply necessary to manufacture only two types of splashguard, a single common main body being used in either case.

FIG. 7 shows the collar designated generally as 40 in position on the fuel delivery device 7. In order to mount the collar 40 in position, the main body 11 is first placed on the scuffguard 7. The splashguard 12 appropriate to the type of fuel delivery device 7 is slid over the nozzle and into engagement with the main body 11 and the scuffguard 7 and the fastener 17 is then tightened to ensure that the collar 40 is held firmly and securely in place.

FIGS. 8*a* to 8*c* show an alternative configuration for the main body. As can best be seen from FIG. 8*b* the main body 50 includes a display support surface 51 onto which a protective cover 52 fits. The display surface 51 and protective cover 52 are, in cross-section, continuously curved across a shallow arc.

The protective cover 52 clips on to the main body, and is removably secured thereto, by means of retainers 54. The retainers 54 comprise projections on the main body which mate with corresponding recesses in a peripheral wall or skirt of the protective cover 52. As a result the protective cover 52 is yet more firmly secured to the main body 50, and will discourage vandalism whilst allowing quick and simple removal by authorized personnel. As a result of the resilience of the material forming the protective cover 52 (for example clear plastics material) the protective cover 52 is simply slid into engagement with the main body 50, with the peripheral wall or skirt engaging a corresponding groove in the main body, and the retainers 54 snapping into mating engagement.

As can best been seen from FIG. 8*c* the main body 50 includes one or more hooks (in the preferred embodiment, 4), each hook being designated 56. These hooks accommodate certain nozzle types on which there are suitable points of hold for the hooks 56. In that case the main body as a whole can simply be snapped onto the nozzle with the hooks engaging under the corresponding holding points on the nozzle. For example in some nozzle types the scuffguard does not fully engage the nozzle head at all points but leaves a gap into which the hooks 56 can enter. As a result the main body can be quickly and securely engaged on the nozzle. An alternative possibility is to provide a "sub-frame" (not shown) in cases where a single main body design does not fit all nozzle types perfectly. In that case the subframe is designed to be fitted onto those nozzle types which do not fit perfectly and the main body introduced over the subframe. The subframe fills the space between the main body and the nozzle, compensating for the ill-fitting of the main body, and allowing more secure attachment of the main body. It will be seen, however, that the hook-type arrangement, where suitable for the given nozzle type, allows a reduction in the number of components to the system.

Referring now to FIGS. 9*a* and 9*b* a further variant of the collar portion according to the present invention is shown at 60. In particular the collar portion 60 is arranged to receive a collar portion adapter 62. The adapter 62 is optional and only needs to be used for nozzles of a first diameter, the collar portion 60 being suitable without the adapter for nozzles of a second, larger diameter. Accordingly, in order to accommodate all nozzle types only a single splashguard/collar portion 60 is required, the adapter 62 being optionally included. As a result manufacturing costs are yet further decreased, in particular as only a single component 60 having the required external finish is required, the adapter 62 only being further included for nozzles of the first diameter. As will be seen the adapter 62 includes projections 64 which engage with recesses 66 in the collar portion 60. As a result the adapter 62 is held firmly in place. Any number of such projections 64 may be used; however, to avoid moulding difficulties it is preferred to have four projections 64 comprising two pairs projecting from substantially opposite sides of the adapter 62.

Referring to FIG. 10, an alternative splashguard shape is shown for splashguard 60. As will be seen the splashguard 60 is roughly egg-shaped, the nozzle aperture being positioned eccentrically at the narrower end. The splashguard 60 is positioned on the nozzle with the narrower end lowermost, such that the majority of the splashguard 60 extends outwardly and above the nozzle. As a result the splashguard 60 still functions well but does not foul conventional "holsters" because it has no appreciable component extending below the nozzle.

It will be appreciated that and it is intended that, features described with reference to one specific embodiment can be adopted, where appropriate, into other embodiments without departing from the invention.

It will be seen that the invention thus allows simple modification of a single component of an information display device allowing the device to be placed on either of for example the two types of "ZVA" nozzles that are currently widely in use. As mentioned above, the invention is, of course, applicable in the case of any suitable nozzle, for example the OPW nozzle. In addition, because of the manner in which the protective window is fitted into the main body of the assembly the removal or loss of the information display surface is prevented or discouraged other than by authorised personnel. It will be appreciated that the assembly could also be used for mounting other items on the scuffguard of a fuel dispensing device if desired. It will further be appreciated that the collar could be suitably configured to be placed on the housing of a fuel delivery device without a scuffguard in place. Although the "filling-in" portion is described as a splashguard in fact that part could comprise simply the projection portion although the splashguard arrangement provides an advantageous combination of features, the splashguard acting additionally as the "filling-in" portion.

I claim:

1. A collar for fitting over at least a portion of the housing of a fuel delivery nozzle wherein the collar comprises a main body securable to the housing and a separate collar portion shaped to mateably engage around a portion of the housing and attachable to the main body for retaining the main body on the housing.

2. A collar as claimed in claim 1 in which the collar portion comprises a splashguard.

3. A collar as claimed in claim 2 in which the collar portion is arranged to mateably engage around a portion of the housing of a conventional fuel delivery nozzle.

4. A collar as claimed in claim 2 in which the collar portion is arranged to mateably engage around a portion of the housing of a vapour recovery fuel delivery nozzle.

5. A collar as claimed in claim 2 in which the main body includes an information display portion.

6. A collar as claimed in claim 5 in which a protective cover is provided for the information display.

7. A collar as claimed in claim 6 wherein the protective cover includes detents for retaining the cover within a surrounding wall of the main body, the information display portion obscuring the detents.

8. A collar as claimed in claim 7 in which the main body defames channels through which the protective cover can be pushed from the underside of the main body to detach the protective cover from the main body.

9. A collar as claimed in claim 1 in which the collar portion is arranged to mateably engage around a portion of the housing of a conventional fuel delivery nozzle.

10. A collar as claimed in claim 1 in which the collar portion is arranged to mateably engage around a portion of the housing of a vapour recovery fuel delivery nozzle.

11. A collar as claimed in claim 1 in which the main body includes an information display portion.

12. A collar as claimed in claim 11 in which a protective cover is provided for the information display.

13. A collar as claimed in claim 1, further including means for securing the main body to the nozzle.

14. A collar for fitting over at least a portion of the housing of a fuel delivery nozzle wherein the collar comprises a main body securable to the housing and a collar portion shaped to mateably engage around a portion of the housing and arranged to engage the main body, wherein the collar portion has a housing-engagable inner face of a first dimension and an adapter removably securable to the collar portion inner face and further has a housing-engagable inner face of a second, generally smaller dimension.

15. A collar as claimed in claim 14 in which the collar portion is shaped to mateably engage around the housing of a fuel delivery nozzle, the housing including a scuffguard.

16. A collar for fitting over at least a portion of the housing of a fuel delivery nozzle wherein the collar comprises a main body including an information display portion and protective cover wherein the protective cover includes detents for retaining the cover within a surrounding wall of the main body, the information display portion obscuring the detents, the main body being securable to the housing; and a collar portion shaped to mateably engage around a portion of the housing and arranged to engage the main body.

17. A collar as claimed in claim 16 in which the main body defines channels through which the protective cover can be pushed from the underside of the main body to detach the protective cover from the main body.

18. A kit for a collar for fitting over the housing of a fuel delivery nozzle, the kit comprising a main body securable to the housing and a separate collar portion arranged to mateably engage around the housing of a fuel delivery nozzle and attachable to the main body for retaining the main body on the housing.

19. A kit as claimed in claim 18 wherein said body includes an information display portion.

20. A kit as claimed in claim 19 further including a protective cover for the information display.

21. A kit as claimed in claim 18, further including means for securing the main body to the nozzle.

22. A display device for a fuel delivery nozzle, the display device including a main body securable to the fuel delivery nozzle for displaying information and a protective cover releasably attachable to the main body for covering the information display wherein the protective cover is received within the main body and wherein the main body includes channels through which the protective cover may be pushed from the underside of the main body to detach the protective cover from the main body.

23. A method of attaching a collar to the housing of a fuel delivery nozzle, the collar including a main body securable to the housing and a separate collar portion for retaining the main body on the housing, comprising the steps of:

placing the main body on the housing;

securing the main body to the housing;

placing the collar portion around the nozzle of the fuel delivery nozzle; and attaching the collar portion to the main body.

24. The method according to claim 23 including, after the engaging step, the steps of:

inserting an information display sheet in a protective cover; and attaching the protective cover to the main body.

25. The method as claimed in claim 23, further including means for securing the main body to the nozzle and including within the securing step that the main body is secured to the housing with the securing means.

26. A method of changing the information display on a collar for a fuel delivery nozzle wherein the collar comprises a main body, an information display and a protective cover for the information display surface detachably fastened to and received within the main body, comprising the steps of pushing the protective cover out of engagement with the main body through a channel from the underside of the main body.

27. The method according to claim 26 including after the pushing step, the steps of:

removing the information display sheet from the protective cover;

inserting a new information display sheet; and re-inserting the protective cover in the main body.

28. A display device for a fuel delivery nozzle, for fitting over at least a portion of the housing of the fuel delivery nozzle, wherein the display device comprises a main body securable to the housing and a separate collar portion shaped to mateably engage around a portion of the housing and attached to the main body for retaining the main body on the housing.

29. A display device as claimed in claim 28, further including means for securing the main body to the nozzle.

30. A collar for fitting over at least a portion of the housing of a fuel delivery nozzle wherein the collar comprises a main body securable to the housing and a collar portion comprising a splashguard, shaped to mateably engage around a portion of the housing and arranged to engage the main body, and further wherein the collar portion has a housing-engagable inner face of a first dimension and an adapter removably securable to the collar portion inner face and further has a housing-engagable inner face of a second, generally smaller dimension.

31. A collar as claimed in claim 30 in which the collar portion is shaped to mateably engage around the housing of a fuel delivery nozzle the housing including a scuffguard.

32. A kit for a collar for fitting over the housing of a fuel delivery nozzle, the kit comprising a main body securable to the housing and further including an information display portion and a protective cover for the information display wherein the protective cover includes detents for retaining the cover within a surrounding wall of the main body, and a collar portion arranged to mateably engage around the housing of fuel delivery nozzle.

33. A kit as claimed in claim 32 wherein the main body defines channels through which the protective cover can be pushed from the underside of the main body to detach the protective cover therefrom.

* * * * *

UNITED STATES PATENT AND TRADEMARK OFFICE

CERTIFICATE OF CORRECTION

PATENT NO. : 6,112,782
DATED : September 5, 2000
INVENTOR(S) : Howard H. Farthing It is certified that error appears in the above-identified patent and that said Letters Patent is hereby corrected as shown below:

Column 8, Claim 8, Line 57:

"defames" should be --defines--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*